United States Patent [19]

Wakai

[11] 4,365,898

[45] Dec. 28, 1982

[54] TIME-CORRECTING MECHANISM FOR ELECTRONIC TIMEPIECE

[75] Inventor: Youichi Wakai, Suwa, Japan

[73] Assignee: Kabushiki Kaisha Suwa Seikosha, Tokyo, Japan

[21] Appl. No.: 117,413

[22] Filed: Jan. 31, 1980

Related U.S. Application Data

[63] Continuation-in-part of Ser. No. 99,170, Nov. 30, 1979, abandoned.

[30] Foreign Application Priority Data

Dec. 5, 1978 [JP] Japan ..... 53-150858
Feb. 2, 1979 [JP] Japan ..... 54-11729

[51] Int. Cl.[3] ..... G04C 9/00
[52] U.S. Cl. ..... 368/187
[58] Field of Search ..... 368/69-70, 368/85, 185-189, 190, 200, 217

[56] References Cited

U.S. PATENT DOCUMENTS 4,091,612 5/1978 Meisner et al. ..... 368/155
4,196,584 4/1980 Oda ..... 368/187
4,209,975 7/1980 Moritani et al. ..... 368/186
4,211,067 7/1980 Oda et al. ..... 368/185
4,222,010 9/1980 Meisner et al. ..... 368/188 X

*Primary Examiner*—Vit W. Miska
*Attorney, Agent, or Firm*—Blum, Kaplan, Friedman, Silberman and Beran

[57] ABSTRACT

A time-correcting mechanism is actuated by a single external member which is rotated, pushed and pulled. Data representative of the rotational speed of the external member is stored in memory and the digital time display is subsequently adjusted in predetermined amounts and rates in accordance with the stored data. In an alternative mechanism, as few as one corrective pulse is applied to a one-minute counter for minor display adjustment when the external member is slowly rotated. More-rapid rotation of the external member causes a plurality of quickly fed pulses to be applied to a one-minute counter, and still more rapid rotation causes pulses to be applied to both the one- and ten-minute counters. Large adjustments in the display are rapidly accomplished.

19 Claims, 7 Drawing Figures

TIME-CORRECTING MECHANISM FOR ELECTRONIC TIMEPIECE

CROSS-REFERENCE TO RELATED APPLICATION

This application is a continuation-in-part of Application Ser. No. 099,170, filed Nov. 30, 1979, for TIME CORRECTING MECHANISM FOR ELECTRONIC TIMEPIECE, now abandoned.

BACKGROUND OF THE INVENTION

This invention relates generally to a time-correcting mechanism for an electronic timepiece and more particularly to a time-correcting mechanism for a digital electronic timepiece in which an externally actuated rotary switch is used to drive the time-correcting mechanism as in an analog timepiece. Conventionally, in a digital timepiece, a pushbutton is used for providing time-correction inputs, and an internal time-correcting mechanism is operated from the pushbutton. When the time setting of an analog timepiece is corrected, the hands move with the motion of the external stem so that the user can sense a cooperation between the stem which he rotates and the hands on the face of the dial. As a result, watch owners who are accustomed to correcting the time for an analog watch are unfamiliar and uncomfortable with the pushbutton mode of correction provided in the digital timepiece.

A digital timepiece using a rotary switch as the input member for a time-correcting mechanism is already known. However, the quick-feeding frequency of pulses applied to drive the visual display for adjustment must be maintained low so that time advancement is sensed gradationally, that is, in visible increments corresponding with the rotary speed of the rotated external member. As a result, the rotation rate of the switch is only practical in providing for a small incremental correction. On the other hand, to achieve a high feeding rate of the display for large magnitude adjustments, the frequency which is used to drive the display must be high so that the adjustment is accomplished in a reasonable time. Such a high frequency causes the display to appear to jump from time to time rather than to change gradationally.

For example, assume a one-minute counter and assume that a 32-minute correction is required. Also assume that the time required or allowed for the correction is 0.25 seconds in view of the time needed for a person to rotate the external switch. If the correction is to be made in 0.25 seconds, time-correcting quick-feeding clock pulses must be fed to the display at a rate of $32/0.25=128$ Hz. However, when the one-minute display is changed at a rate of 128 Hz, it is not visible to the eye that the minute display is changing gradationally, that is, in steps. Moreover, in order to control the application of 32 clock pulses, the circuit will require a large increase in the number of gates and other circuit elements.

What is needed is a time-correcting mechanism for a completely electronic digital timepiece which is operated by an external rotary switch or stem and which provides correction rates which are proportional to the rates applied in rotating the external member.

SUMMARY OF THE INVENTION

Generally speaking, in accordance with the invention, a time-correcting mechanism for a digital electronic timepiece especially adapted to simulate the correcting mechanism of an analog timepiece is provided. The time-correcting mechanism according to this invention uses a rotary switch as an inputting mechanism for time correction and controls a quick-feeding electronic clock signal, used for time correction, by means of the rotating speed of the external rotary switch. Thus, the display is sensed to change according to the operation of the external rotary switch. When the switch is rotated slowly, the change in the display is at a slow rate. When the rotating speed of the switch is rapid, the correction rate is rapid.

In a time-correcting mechanism in accordance with this invention, data representative of the rotational speed of the external member is stored in memory, and the digital time display is subsequently adjusted in predetermined amounts and rates in accordance with the stored data.

In an alternative time-correcting mechanism according to this invention, a corrective pulse is applied to the one-minute counter when the external member is slowly rotated. More-rapid rotation of the external member causes pulses to be applied to the one-minute counter, and still more rapid rotation causes pulses to be applied to both the one- and ten-minute counters.

Only four clock pulses of 32 Hz are inputted to the lowest bit of a ten-minute counter and a one-minute counter when the rotating speed of the external switch is rapid. Thus, the time correction amounts to 44 minutes. Further, the time required for time correction is as little as 0.12 seconds, that is, half of the time cited in the previous example, even when the frequency of the input clock pulses is only 32 Hz. In making such a change on a ten-minute counter, the time display is visibly changed in steps. Also, when a ten-minute counter is used in order to limit the required number of clock pulses, the complexity of the circuitry may be reduced by half.

Accordingly, it is an object of this invention to provide an improved time-correcting mechanism for an electronic timepiece which corrects the time displayed by turning an external member.

Another object of this invention is to provide an improved time-correcting mechanism for an electronic timepiece which corrects the display at rates which are directly related to the rate of rotation of an external member.

A further object of this invention is to provide an improved time-correcting mechanism for an electronic timepiece which changes a digital display in a gradational manner.

Still another object of this invention is to provide an improved time-correcting mechanism for an electronic timepiece having a digital display, so that the user has the same sense of operation as in adjusting the display of an analog timepiece.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

In a time-correcting mechanism according to this invention, the speed of changing the external switch from ON to OFF is segregated into classes in the circuit, and the information about the segregated speed classes is memorized in plural memories. Information in the memories, that is, the input speed of switch rotation, determines the rate and the number of pulses for time correction and the digit of time to be corrected. In this way, the digitally displayed time can be rapidly corrected by a quick-feeding frequency, and the correction is sensed to correspond to the operation of the external rotary switch. Moreover, the quick correction is accomplished after the rotary switch is in an OFF position by using the information representative of the input speed of the switch which is stored in the memories. Thus, when this quick-feeding quantity is adjusted according to the contents of the memory stages, the aftereffect of a quick correction remains even after the switch has been placed in the OFF position. The relationship between switch rotation and the quick correction of the digital display thereby is similar to that in the correction of the time display of an analog watch.

The following is an explanation of a time-correcting circuit in accordance with this invention. Rotational speed of the external switch corresponds to the time period in which the switch changes from ON to OFF, that is, rapid rotation of the switch produces a shorter time period between the ON and OFF conditions.

Figure 1:
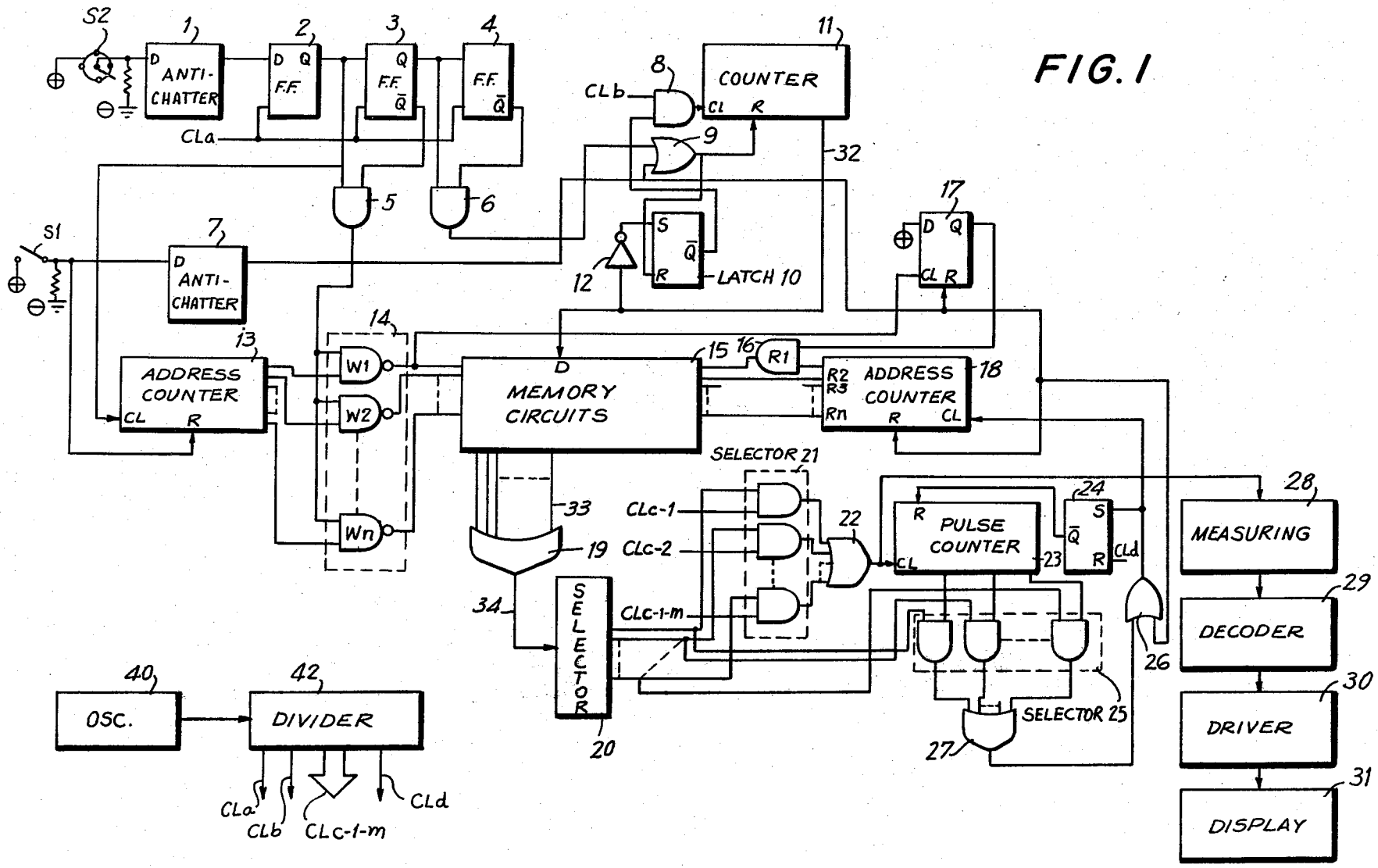
FIG. 1 is a circuit drawing for an electronic digital timepiece with time-correcting mechanism in accordance with this invention.

The input portion of the time-correcting circuitry is represented by switches S1 and S2, as shown in FIG. 1. The switch S1 is a reset switch. The rotary switch S2 is adjusted to input signals after the switch S1 becomes ON. These switches S1, S2 cooperate with each other, that is, the switch S2 is enabled to input signals to the circuits after the switch S1 provides an input. For example, the rotary external member, that is, a rotary stem, can have two stable positions, namely, pushed in or pulled out. To correct time, the switch S1 provides its input when the stem is placed in the "pulled-out" condition, and then the stem is rotated to provide the inputs of S2. The switch S2 includes a plurality of contacts which make and break connection with a voltage source indicated as + as the switch is manually rotated.

Figure 3:
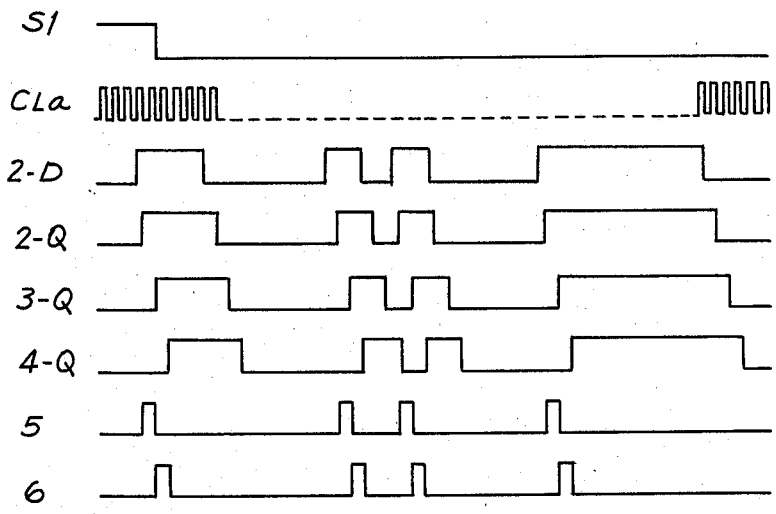
FIG. 3 presents timing charts and waveforms associated with the circuit drawing of FIG. 1.

As the rotary switch S2 is turned and repeatedly changes from ON to OFF, signals are applied to the input terminal D of the flip-flop 2 after the signals pass through an antichatter circuit 1. In the conventional manner, the input signal at terminal D of flip-flop 2 is applied in turn to series flip-flops 3, 4. To an AND gate 5 are applied the signal Q out of the flip-flop 2 and the signal $\overline{Q}$ of flip-flop 3. Thereby, a differential signal addressing each memory segment of a memory circuit 15, which will be described later, is obtained from the AND gate 5. From an AND gate 6, to which are applied a signal Q from the flip-flop 3 and the signal $\overline{Q}$ from the flip-flop 4, a differential signal resetting the contents of a counter 11 is obtained. The counter 11 measures the inputting speed of the switch S2 as described hereinafter. The pulse width of the differential signals from the gates 5, 6 is determined by the frequency of a clock signal CLa which is produced by a high-frequency oscillator 40 and divider network 42 in a conventional manner and applied to the flip-flops 2, 3, 4. The pulse width of the clock signal CLa is narrow. FIG. 3 shows the timing charts and waveforms of the signals applied to the D terminal of the flip-flop 2 by means of the rotary switch S2 and the resultant output signals of the gates 5, 6.

Figure 2:
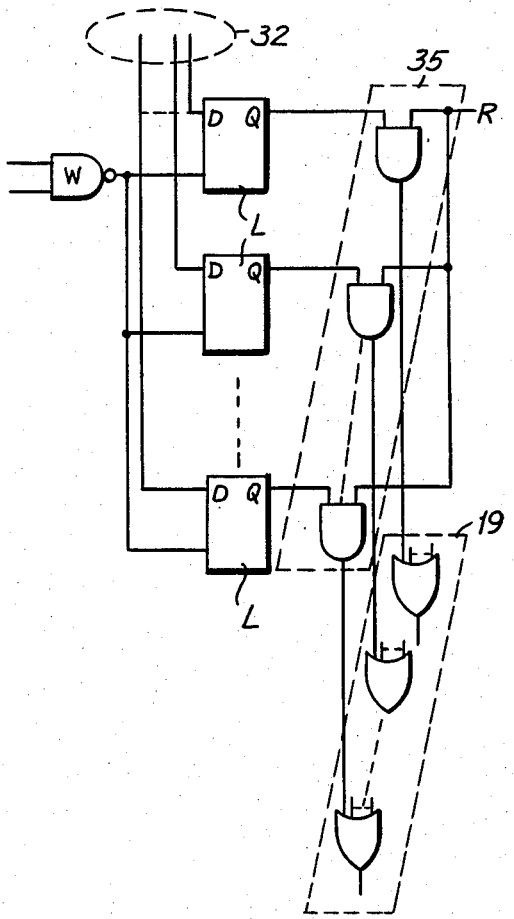
FIG. 2 is a circuit drawing of a portion of the memory in the circuit of FIG. 1.

The counter 11 for detecting the speed of the rotary switch S2 and controls for this counter are now explained. The counter 11 includes divider circuits comprised of a plurality of serially connected flip-flops. The contents of the counter 11 are reset by the ON signal produced by the switch S1 after the signal passes through an antichatter circuit 7 and an OR gate 9. Simultaneously, a resetting signal output from the OR gate 9 passes through a set-reset latch 10, opens or enables an AND gate 8 connected to the Q terminal of the latch 10, and thereby applies a clock signal CLb from the divider network 42 to the input of the counter 11. The state of the latch 10 is controlled by an input signal from an inverter 12 when data is later supplied from the counter 11 to memory circuits 15. The counter 11 accumulates the time pulses CLb until a reset signal, that is, the output signal of AND gate 6 produced by operation of the rotary switch S2, is inputted to the reset terminal of the counter 11. As stated, when the reset signal is applied to the counter 11 from the AND gate 6, the counter 11 is reset. However, immediately before being reset, the counter 11 writes the contents of each dividing stage of its flip-flop circuitry into memory circuits 15 through a data bus 32. The timing for writing into the memory circuits 15 is at the rise of the differential signal outputted from the AND gate 6. The period from ON to OFF of the switch S2 corresponds to the period of the reset signal of the gate 6. The time period between each reset signal determines the content or state of the flip-flop in each dividing stage of the counter 11 at the instant the counter 11 is reset. The period from ON to OFF is segregated into several classes. At each writing interval, the content of each flip-flop of the divider stages, that is, the signal Q or $\overline{Q}$ at a high level or a low level, passes through the data bus 32 and is connected to the data input terminal D of a latch L of a memory element (FIG. 2). A plurality of memory elements constitutes the memory circuits 15.

The signal output from terminal Q of the flip-flop 2 is inputted to the AND gate 5 and is also applied as a clock signal to a counter 13 which is used for setting, in sequence, the address for writing into the memory circuits 15 the data from the counter 11. The counter 13, after being reset by initial actuation of the switch S1, sequentially selects one of the NAND gates 14 among the gates W1 through Wn by accumulating clock signals delivered from the terminal Q of flip-flop 2. One of the NAND gates 14 functions upon the concurrent application of the output of the counter 13 and the output differential signal of the AND gate 5. When the differential signal pulse of the gate 5 is applied, this one NAND gate 14, also having the output of the counter 13, enables the writing of the contents of the counter 11 into a selected memory element of the memory circuits 15. Each memory element of the memory circuits 15 has a configuration as shown in FIG. 2. The content of each dividing stage of the counter 11 is applied to the data terminal D of one latch L of one memory element through the data bus 32. The clock signal for each latch L is an output of the selected one of the NAND gates 14. Thus, the count accumulated in counter 11 between output signals from the AND gate 6 is stored in the memory circuits 15.

Reading of the contents of the memory circuits 15 is controlled by a counter 18 for selecting a readout address. The counter 18 is reset by initial actuation of the switch S1. When the differential signal for writing an address is outputted from the NAND gate W1 of gates 14, the output of AND gate R1 is unblocked because the same signal from gate W1 causes the signal Q of a flip-flop 17 to change from a low level to a high level. Then, the contents of the first memory of the memory circuits 15 commence to be read out. The readout portion 35 (FIG. 2) of each memory includes AND gates each having a latch L output Q as an input and a selected address Rn (n=1, 2, . . . ). Each information bit from the memory 15, passed through an AND gate of gates 35, also passes an OR gate of gates 19. The memories 15 are constructed with plural OR gates 19, as shown in FIG. 2. The output of the gates 19 is fed into a decoder or selector 20 for operating on data representative of the time period of the rotary switch S2 in changing from ON to OFF. After the nth memory element has been inputted and read out, the next input to the memory circuits 15 is made, again by way of gate W1, with the readout address being selected by gate R1. Thus the correction process can be extended in duration.

The output of the selector 20 is inputted to one terminal of a selector 21 for determining the frequency of a quick-feeding signal which is to be used for time correction. The selector 21 selects the quick-feeding clock pulses appropriate to the data from the one memory address which is being read out and applied to the selector 20. When information is quickly inputted by the switch S2, a clock pulse of high frequency, provided by one of the clock signals CLc1-CLcm, passes through the AND gate 21 enabled by the information signal from the selector 20. The selected clock pulse frequency CLc passes through the one enabled gate of selector 21, then passes through an OR gate 22 and is inputted to a counter 23. The pulses from the OR gate 22 also are applied to the measuring circuit 28 to correct the display 31. The counter 23, comprising flip-flop dividing circuits, and a selector 25 determine the number of quick-feeding clock pulses which will be provided to correct the display. As the number of quick-feeding clock pulses amounts to one of several predetermined quantities, the signal Q of the associated flip-flop in the dividing circuits of the counter 23 changes to a high level, which is inputted to an individual AND gate of the selector 25. The AND gates in the selector 25 are selectively enabled by the signal from the selector 20, which also determines the frequency CLc in the selector 21. Receiving an output signal from the selector 20, the enabled gate in the selector 25 passes a signal when the associated divider stage of the counter 23 turns high. This signal passed through the selector 25 is inputted to an OR gate 27 and then to an OR gate 26, from which it is passed through a set-reset latch 24, and inputted to the reset terminal R of the counter 23 and to the clock terminal of the counter 18 for selecting a readout address. When the counter 18 is clocked, the readout address advances by one, and the next memory element in the memory circuits 15 is designated for readout. The reset signal inputted to the set-reset latch 24 is converted to a signal of constant pulse width, determined by a high-frequency signal CLd, and is applied to the reset terminal of the counter 23. In this way, the counter 23 determines when the readout address of the memory circuits 15 is advanced and thereby controls the number of quick-feeding clock pulses at the selected frequency CLc.

As indicated above, the quick-feeding pulses at a selected frequency CLc, delivered from the OR gate 22, pass through a conventional time-measuring counter 28, a decoder 29 and a display driver 30, and cause an accelerated advancement of the presented digits in the display portion 31.

In this correcting mechanism the speed of the rotary switch in changing from ON to OFF is discriminated in accordance with the accumulated count in the flip-flop divider stages of the counter 11. Because one clock signal CLc of the many clock signals supplied to the AND gates of the selector 21 is selected corresponding to the switch speeds, the frequency of the quick-feeding signal is a variable. The number of quick-feeding clock pulses, that is, the time-correction rate, becomes adjustable, depending on which dividing stage flip-flop of the counter 23 outputs the signal to activate the enabled selector 25. Information related to the rotational speed of the switch S2, in changing from ON to OFF, is stored in the memory circuit 15 and is read out by means of the shift register counter 18 after the rotary switch S2 changes to an OFF condition. The displayed time is quickly advanced for correction by clock pulses CLc, having a selected frequency and duration determined in response to this stored rotational-speed information. As a result, the user has a reaction for the correcting operation of the digital timepiece in accordance with this invention which is similar to that in correcting an analog timepiece.

Further, if the quick-feeding clock pulses generated by the time-correcting circuits shown in FIG. 1, in particular the output of the OR gate 22, are applied to the counter 23 for either up or down counting, the time may be easily advanced or retarded. For such a mode of operation, the time correction can still be made similar to that of an analog timepiece by having the rotating direction of the rotary switch S2 determine whether the correction in time is to be for advancement or retardation of the displayed time.

Figure 4:
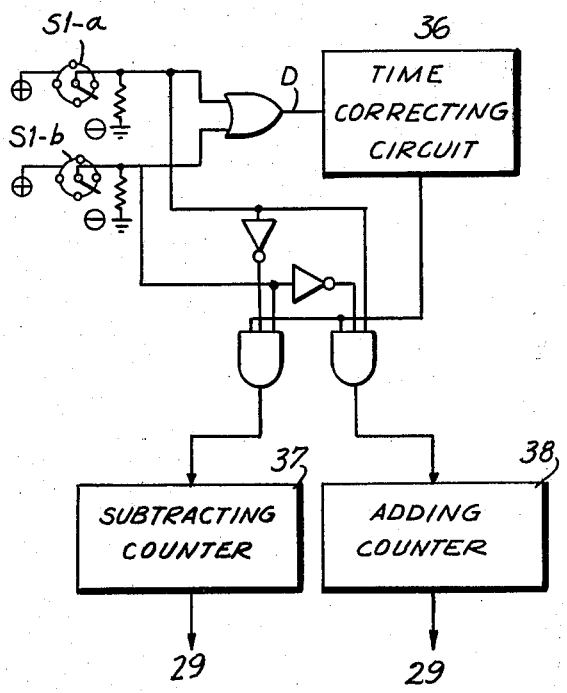
FIG. 4 is an alternative embodiment of the timepiece of FIG. 1.

FIG. 4 shows an alternative time-correcting mechanism according to this invention provided with a mechanism for advancing and retarding the time. S1-a is a rotary switch for time advancement. S1-b is a rotary switch for time retardation. The numeral 36 is a time-correcting mechanism according to this invention, where D of FIG. 4 corresponds to the inlet terminal D of the antichatter circuit 1 of FIG. 1. The circuit includes a subtracting counter 37 and an adding counter 38. The outputs of the counters 37, 38 are connected to the decoder portion of the timepiece circuit.

In another alternative embodiment of this invention, when an inverter is provided at the output of the rotary switch S2, that is, at the input terminal D of the antichatter circuit 1, the data terminal D of the antichatter circuit 1 is generally at a high level and changes to a low level when the switch S2 is ON. When the rotary switch S2 disconnects from a contact, that is, changes to OFF, an audible warning (from a device not shown) is emitted, and then a signal is inputted to the data terminal D of the antichatter circuit 1. Thus, the time is corrected just after the sound is emitted indicating a switch actuation. The user senses that the time correction is being properly accomplished because the audible warning occurs just prior to the visible correction of time.

Figure 5:
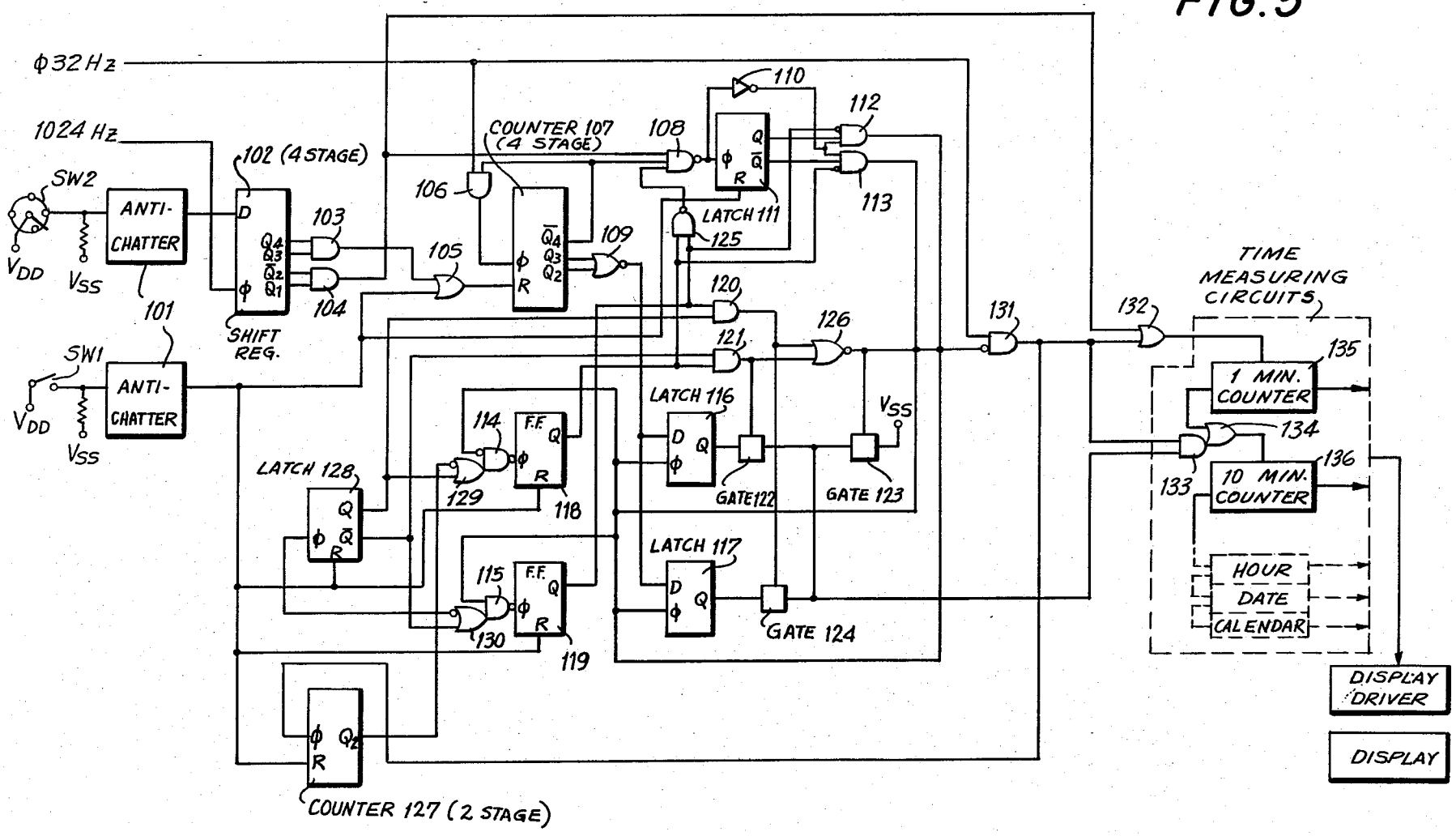
FIG. 5 is a circuit drawing for another alternative embodiment of an electronic digital timepiece with time-correcting mechanism in accordance with this invention.

Another alternative embodiment of a time-correcting mechanism for a digital electronic timepiece in accordance with this invention is described hereinafter with respect to FIGS. 5, 6 and 7. In FIG. 5, a reset switch Sw1, when actuated, resets flip-flops and counters of the circuit as explained hereinafter. A rotary switch Sw2 is also used in correcting the time which is displayed on the face (not shown) of the timepiece. These switches Sw1 and Sw2 cooperate with each other. The rotary switch Sw2 provides an input signal after the switch Sw1 has provided an input signal. For an example of cooperating switches, an external stem has two stable positions, namely, a conventional pushed-in position and a pulled-out position. At the "pulled-out" position, the switch Sw1 provides an output signal, and following that, the switch Sw2 is rotated for time correction.

In the following example, correction of the minutes display of a timepiece will be described. All flip-flops in the circuit operate to form a $\frac{1}{2}$ counter.

The rotating speed of the rotary switch Sw2 is divided into three classes, to which time-correction rates are made to correspond. The time period for the switch Sw2 to change ON-OFF-ON is designated as t. More particularly, the rotating speeds have three classifications, as follows: In one class, $t \leqq 62.5$ milliseconds. In the middle classification, $t \geqq 62.5$ milliseconds but is $\geqq 250$ milliseconds. In the third classification, t is $\geqq 250$ milliseconds.

This time range may include some variation, which is changed in accordance with the clock pulse frequency applied to a time-measuring counter 107. The above time ranges are based on a clock frequency of 32 Hz. A shift register 102 has four stages, which are timed by a clock signal of high frequency in the range of 1 kilohertz, in this example 1024 Hz. The counter 107 also has four stages, and a counter 127 has two stages. The suffix numbers, in the drawings, annexed to the characters Q or $\overline{Q}$ in a counter indicate the stage number of the flip-flop in the counter. For example, the output Q3 of counter 107 represents the Q output of the third flip-flop stage in the counter 107.

In the initial operation, the switch Sw1 turns ON and resets the counters in the circuit. The counter 107 detects the time period for the rotary switch Sw2 to change ON-OFF-ON. The terminal $\overline{Q}4$ of the counter 107, reset by the switch Sw1, goes to a high level, which unblocks an AND gate 106 and thereby inputs clock pulses of 32 Hz into the counter 107. If another reset signal from the OR gate 105 is not applied within a predetermined period of time, the terminal $\overline{Q}4$ of the counter 107 goes to a low level. More particularly, after eight cycles (250 millisecond) of the 32 Hz signal are inputted to the counter 107, the $\overline{Q}$ terminal goes low. The low from $\overline{Q}4$ inhibits the 32 Hz signal from the AND gates 106, and the counter 107 is maintained in this condition.

The signal 102D shown in the timing chart of FIG. 2 is an output signal delivered from the antichatter circuit 101 by way of the rotary switch Sw2 and inputted to the D terminal of the shift register 102. Thus, in the timing charts of FIG. 6, the signals are identified by the reference numeral of the component to which they apply and to particular terminals thereof as appropriate. A differential signal of the input signal 102D is made by gates 103, 104 using as inputs the outputs Q and $\overline{Q}$ from the shift register 102. Both signals 103, 104 from the AND gates 103, 104, respectively, have a width of approximately 1 millisecond as a result of the 1 kilohertz clock signal. The signal 103 from the AND gate 103 is delayed by 1 millisecond from the signal 104. The output signal a of the AND gate 104, produced by the first input of the rotary switch Sw2, passes through an OR gate 132 and is inputted to a one-minute counter 135 as a correcting clock pulse. Because of slow rotation, the rotary switch Sw2 is not turned ON again during the time period of 250 milliseconds extending from the moment when the counter 107 is reset by the switch Sw1 to the time when the terminal $\overline{Q}4$ of the counter 107 becomes low. The output signal of the AND gate 104 is inhibited in the NAND gate 108 because the signal $\overline{Q}4$ of the counter 107 is at the low level which inhibited the gate 106. Thus, the circuit 135 cannot be driven by the 32 Hz signal, and the minute counter 135 is inputted only one clock pulse for correcting the time by one minute. This results because the outputs of AND gates 120, 121 are at a low level, so that a NOR gate 126 outputs a high signal and the AND gate 131 is blocked, preventing passage of the 32 Hz signal.

In the next class of switch rotation, the signal a from the AND gate 103 passes through the OR gate 105 and resets the counter 107. Accordingly, the signal $\overline{Q}4$ of the counter 107 goes to a high level and releases, that is, opens, the gates 106 and 108. The counter 103 has the 32 Hz clock signal applied and counts the 32 Hz signal pulses as described above. When the rotary switch Sw2 inputs a signal such that the time t between signals a and b is in the range 62.5 to 250 milliseconds inclusive, the output signal b of the AND gate 104 passes the NAND gate 108 and becomes a clock signal for a flip-flop 111. The signal Q, outputted from the flip-flop 111, is applied to the AND gate 112, and the signal $\overline{Q}$ is inputted to gate 113. The contents of the counter 107 are written into a latch 116, which is clocked by the output signal of the AND gate 113. The input to the latch 116 is the signal generated by a NOR gate 109, which has been inputted the outputs Q2 and Q3 of the counter 107. In this condition, a low is written in the latch 116.

At the same time, the output signal of the AND gate 113 is passed through a NAND gate 114 and is inputted to a flip-flop 118 as a clock signal. As shown in FIG. 6, the output signal Q of the flip-flop 118 changes from a low to a high level. This high signal inhibits the AND gate 113 for a period of time. The level of the output signal from AND gate 121 changes from a low level to a high level corresponding to the high level of the output signal Q of a flip-flop 128. When the level of the output signal of the AND gate 121 becomes high, the transmission gate 122 opens and the content, that is, a low, of the latch 116 is outputted. The AND gate 133 is blocked when an input signal is at the low level, but with the output signal of the AND gate 121 at a high level, the output signal of the NOR gate 126 is low, and the output signal of 32 Hz from the AND gate 131 passes through the OR gate 132 and is inputted to the one-minute counter. Thus, a quick-feeding signal is inputted to the one-minute counter 135 but not to the ten-minute counter 136 because gate 133 is blocked as described above. In this condition, the clock signal for the time correction is the 32 Hz signal passed through the AND gate 131. The number of 32 Hz pulses is also inputted to and counted by the counter 127. As this signal is counted, the output signal 127Q2 from the terminal Q2 of the counter 127 is a clock signal inputted to the flip-flop 128 as a high signal each time the counter 127 receives four 32 Hz signals. The signal Q2 from the counter 127 and the signal Q from the flip-flop 128 pass through an OR gate 129 to become a clock signal for the counter 118. When the signal Q of the flip-flop 128 changes from a low level to a high level, the output of the gate 121 goes to the low level. The gate 120 goes high and the contents of the latch 117 are read out, and the time-correcting signal resulting from the differential signal b inputted by the rotary switch Sw2 is cut off when the one-minute counter 135 has been inputted with four 32 Hz clock pulses. These are the first four clock pulses of the AND gate 131 shown in FIG. 6.

In the third class of switch rotation speed, shortly after the output b from the AND gate 104 is delivered, the signal b from the AND gate 103 resets the counter 107 again and the counter 107 begins to count as described above, preparing for the next differential input signal of the switch Sw2.

When a signal c is outputted from the AND gate 104 following the signal b after an elapsed time between the signals b and c which is equal to or less than 62.5 milliseconds, the AND gate 112 is selected by means of a high output Q from the flip-flop 111 and outputs a signal c. The high output of the NOR gate 109 is written into the latch 117, clocked by means of the high output signal c from the AND gate 112. At the same time, the Q signal output of the flip-flop 119 changes from low to high. When the Q output of the flip-flop 128 changes from low to high, the content of the latch 116 is unable to be read out by the low output from AND gate 121. The output signal of the AND gate 120 changes to a high level by a high signal at the Q terminal of the flip-flop 128 and a high signal at the Q terminal of the flip-flop 119. Then the transmission gate 124 is opened and the contents of the latch 117 are read out. The high-level signal Q of the latch 117 opens the AND gate 133, and the output signal of the AND gate 131 is inputted through an OR gate 134 to the ten-minute counter 136. Because the output of the AND gate 120 is high and the resultant output of the NOR gate 126 is low, the AND gate 131 lets the 32 Hz signal pass. The quick-feeding 32 Hz clock pulses are also passed through the OR gate 132 to the one-minute counter 135 while simultaneously passing through the AND gate 133 and OR gate 134. Thus, the signal is inputted to both the one-minute counter 135 and the ten-minute counter 136.

The number of quick-feeding clock pulses is controlled in the following way. At the moment when the counter 127 has received and counted four clock pulses, the signal outputted from the terminal Q2 of the counter 127 reverses the conditions at the Q and $\overline{Q}$ terminals of the flip-flop 128 so that the output of the AND gate 121 goes low as the output $\overline{Q}$ of the flip-flop 128 goes low. With the output of the AND gate 120 being low, the output of the NOR gate 126 becomes high. The high signal from the NOR gate 126 inhibits the AND gate 131 and blocks the input of the quick-feeding 32 Hz signal into the counters 135, 136. During this period, both the one-minute counter 135 and the ten-minute counter 136 are inputted four clock pulses, as is shown on the output signals of the AND gates 131 and 133 in FIG. 6. Thus, the total time correction amounts to 44 minutes.

When a pulse is outputted from the AND gate 104 at a short interval after the differential signal is inputted by the rotary switch SW2, each output Q of the flip-flops 118, 119 is at a high level. Therefore, the NAND gate 125 outputs a low-level signal, and the pulse d is inhibited by the NAND gate 108. Otherwise, the content of the counter 107 corresponding to the interval of the switching differential pulse shall be written into each latch 116, 117, and a quick-feeding 32 Hz pulse shall not be inputted to the counter. The differential signal outputted from the AND gate 104 is inhibited by the NAND gate 108 and the AND gate 112 or the AND gate 113.

Figure 6:
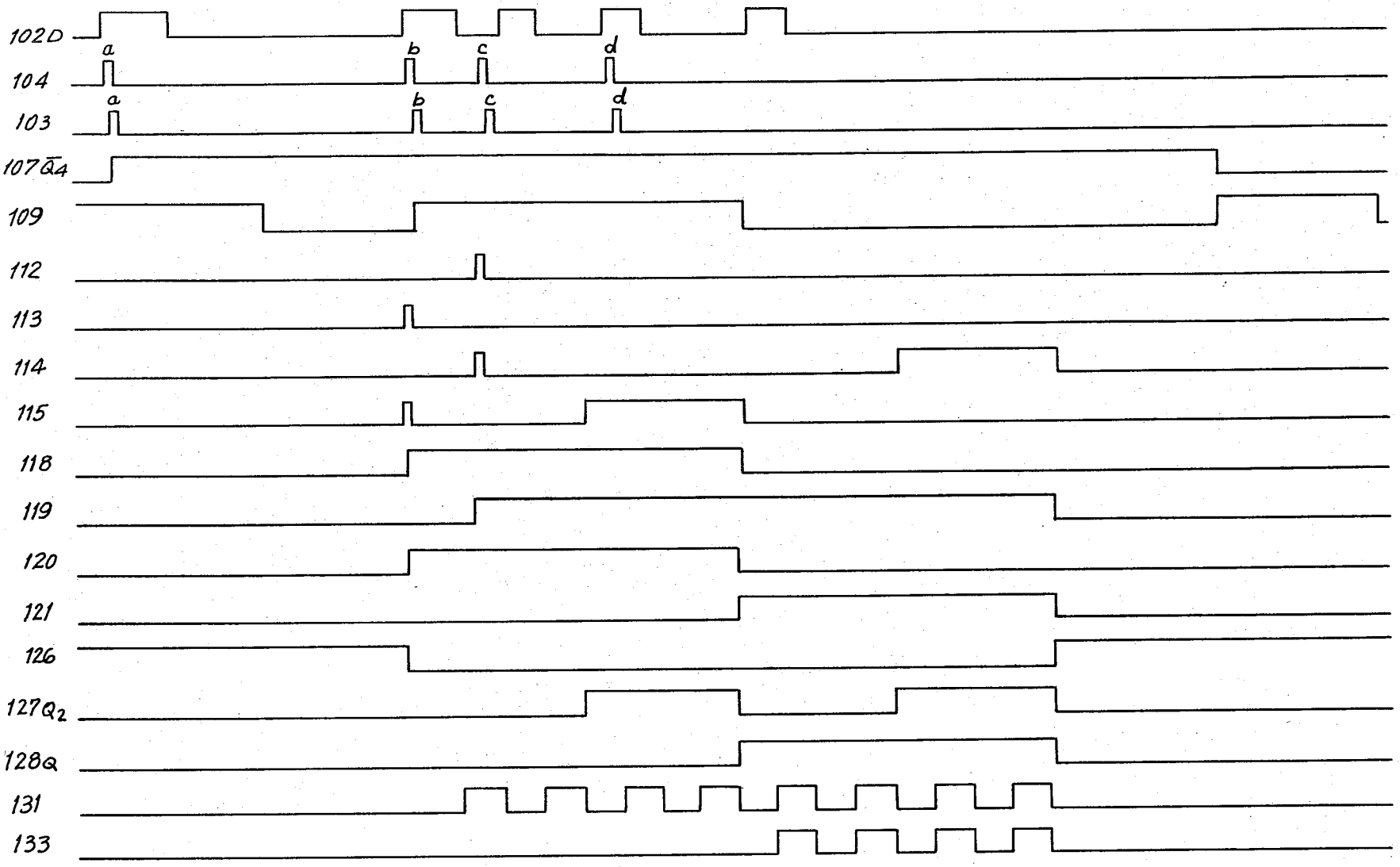
FIG. 6 shows timing charts and waveforms associated with the circuit drawing of FIG. 5.

As shown in FIG. 6, before the AND gate 104 outputs the pulse d, the counter 107 is reset by the output d of the AND gate 103 and begins once again to count the 32 Hz signal. After the counter 107 counts eight pulses and obtains a time measurement of $8/32=250$ milliseconds, the counter 107 inhibits the NAND gate 108 and the AND gate 103 from outputting a signal. When the rotary switch Sw2 inputs a signal and the differential pulse is outputted from the AND gate 103, only a differential pulse of the AND gate 104 is inputted to the one-minute counter 135, and the time is corrected by one minute.

In summarizing, the rotating speed of the switch Sw2, that is, the inputted rotating speed, determines the switching interval ON-OFF-ON. The rotating speed is categorized into three classes and a correcting rate, namely, the number of quick-feeding 32 Hz pulses, is controlled in correlation with the three classes. In a conventional design, when a binary counter is used as a counter for measuring the number of inputted clock pulses for quick feeding, and when the corrective clock pulse is inputted only to the one-minute counter so that the counter is fed over a long period of time, the time is first corrected by 32 minutes, which is the nearest amount to 44 minutes. This requires that three stages of flip-flops be provided. The time required for feeding the clock pulses at a rate of 32 Hz is as much as $32/32=1$ second. As a result, the display is sensed to change slowly. Further, the correcting rate is small in comparison with the rate in accordance with this invention, which also inputs pulses to the ten-minute counter.

In the circuit embodiment of FIG. 5, the number of the time-correcting quick-feeding clock pulses of 32 Hz is counted directly in the counter 127 and thereby controlled. However, in an alternative embodiment of this invention, there is another suitable circuit for controlling the count. A signal having a frequency other than that of the quick-feeding clock signal is inputted to a counter of many stages, as shown in FIG. 7, so as to measure a predetermined time and to control the number of quick-feeding clock pulses thereby.

Figure 7:
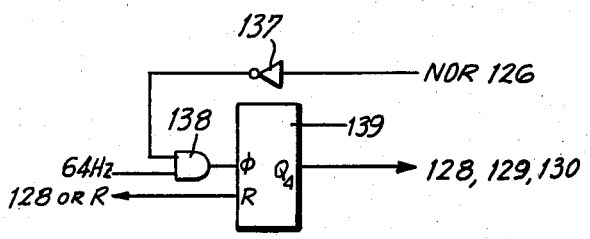
FIG. 7 is an alternative circuit portion which in combination with the circuit of FIG. 5 provides another alternative embodiment of this invention.

In FIG. 7, a counter 139 for measuring the duration of the quick feeding is provided in place of the counter 127 in FIG. 5. This counter 139 is constructed of four flip-flop stages and has a clock input signal of 64 Hz passing through an AND gate 138. The signal from the NOR gate 126 is inputted to the AND gate 138 through an inverter 137. When either of the AND gates 120, 121 of FIG. 5 outputs a high-level signal, the AND gate 138 is released to input the clock signal of 64 Hz to the counter 139. The signal Q4 of the flip-flop, that is, from the last stage of the counter 139, is inputted to the clock terminal of the flip-flop 128 and to an inverting terminal of the OR gates 129, 130. Then, every time a pulse is outputted from the terminal Q4 of the counter 139, the AND gates 120, 121 are inhibited to output a signal for reading out the contents of the latches 116, 117. As a result, the number of the 64 Hz clock pulses for time correction which are inputted to the AND gate 131 is controlled. In this embodiment, the counter 139 measures 250 milliseconds, and during this period, either of the AND gates 120, 121 is released to output a latch-reading signal.

These are two ways for controlling the number of rapid time-correcting clock pulses which are fed to the minute counters 135, 136. An embodiment of this invention in which the time is corrected by using a rotary switch has been described. Because of this mechanism, the time may be corrected using a small rotation of the switch. Further, when a large time correction is to be made, the time required for the correction is still small. In such a case, rapid time-correcting clock pulses are inputted to an upper bit (ten-minute) of a time-measuring counter, so that a comparatively low number of clock pulses need to be inputted to effect a large change. The display changes at a speed which the user finds familiar and acceptable.

In an embodiment of this invention described above, a one-minute counter and a ten-minute counter are used for time-keeping measurements. For date correction, a "one-date" counter and a "ten-date" counter are operated in a manner similar to that of the minute counters described above, and a similar correcting mechanism is provided for operation with a rotary external member.

A time-correcting mechanism in accordance with this invention, operating from a rotary stem member, makes the user feel comfortable in using a method similar to that applied with an analog timepiece. The display changes in an acceptable gradational manner and a wide range of changes can be made readily.

It will thus be seen that the objects set forth above, and those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A time-correcting mechanism for a digital electronic timepiece having a high-frequency standard oscillator and a divider network receiving signals therefrom, said divider network outputting lower-frequency clocking and time-keeping signals, time-measuring circuits and means for display, comprising:

rotary switching means including contacts, said contacts opening and closing to produce switching signals when said rotary switching means is rotated;

circuit means for sensing said switching signals and determining the speed of rotation of said rotary switching means;

circuit means for inputting supplemental pulses into said time-measuring circuits for correcting said display, said supplemental pulses being provided by said divider signals, the number of said supplemental pulses being selected in correspondence with said rotational speed of said rotary switching means; and memory means for storing rotational speed data generated by said circuit means for sensing rotational speed, said circuit means for inputting supplemental pulses being adapted to read-out said stored data after said rotary switching means is stopped from rotating.

2. A time-correcting mechanism as claimed in claim 1, and further comprising selector means reading said data stored in said memory means and enabling said circuit means for inputting supplemental pulses to select the number of said supplemental pulses.

3. A time-correcting mechanism as claimed in claim 2, wherein said selector means for reading said data stored in said memory enables circuit means for determining the frequency of supplemental pulses to be inputted in the selected number to said time-measuring circuits.

4. A time-correcting mechanism as claimed in claim 3, wherein said memory means is adapted to write in and store data when said rotary switching means is closed or ON.

5. A time-correcting mechanism as claimed in claim 4, wherein said memory means is adapted to read out said stored speed data when said rotary switching means is open or OFF.

6. A time-correcting mechanism as claimed in claim 1, wherein said rotary switching means is rotatable in both directions, said switching means contacts producing discrete switching signals representative of contact openings and closings in each direction, said supplemental pulses inputted to said time-measuring circuits for correcting said display being additive or subtractive dependent upon the rotational direction of said rotary switching means, whereby said display is selectively advanced or retarded for correction.

7. A time-correcting mechanism for a digital electronic timepiece having a high-frequency standard oscillator and a divider network receiving signals therefrom, said divider network outputting lower-frequency clocking and timekeeping signals, time-measuring circuits and means for display, comprising:

rotary switching means including contacts, said contacts opening and closing to produce switching signals when said rotary switching means is rotated;

circuit means for sensing said switching signals and determining the speed of rotation of said rotary switching means, said circuit means for sensing and switching signals including a counter, said counter counting a clocking signal from said divider network during the time between actuations of said rotary switching means contacts when said rotary switching means is rotated;

circuit means for inputting supplemental pulses into said time-measuring circuits for correcting said display, said supplemental pulses being provided by said divider signals, the number of said supplemental pulses being selected in correspondence with said rotational speed of said rotary switching means;

memory means for storing rotational speed data generated by said circuit means for sensing rotational speed, said memory means being comprised of a plurality of memory addresses, said addresses being written into and read-out in sequence, said memory means being adapted to write and store data when said rotating switch means is closed or ON, and further adapted to read-out said stored speed data when said rotary switching means is open or OFF; and selector means for reading said data stored in said memory means and enabling said circuit means for inputting supplemental pulses to select the number of said supplemental pulses, said selector means for reading said data stored in said memory enabling circuit means for determining the frequency of supplemental pulses to be inputted in said selected number of said time measuring circuits.

8. A time-correcting mechanism as claimed in claim 1, or 2, wherein said rotational speed data is determined by the time between actuations of said rotary switching means contacts when said rotary switching means is rotated.

9. A time-correcting mechanism as claimed in claim 7, wherein said memory address is advanced for write-in when said rotary switching means contacts are closed, and said memory address for readout is advanced after said supplemental pulses have been inputted into said time-measuring circuits.

10. A time-correcting mechanism as claimed in claim 9, wherein said first memory address is written into after said last memory address has been written into, and said first memory address is read out after said last memory address has been read out, whereby said sequence is restarted and said memory means are adapted for continuous operation of said rotary switching means.

11. A time-correcting mechanism as claimed in claim 7, and further comprising means for resetting said counter and said memory addresses for write-in and readout prior to rotation of said rotary switching means.

12. A time-correcting mechanism as claimed in claim 1 or 7, wherein said supplemental pulses correct a display of time.

13. A time-correcting mechanism for a digital electronic timepiece having a high-frequency standard oscillator and a divider network receiving signals therefrom, said divider network outputting lower-frequency clocking and timekeeping signals, time-measuring circuits and means for display, comprising:

a rotary switching means including contacts, said contacts opening and closing to produce switching signals when said rotary switching means is rotated;

circuit means for sensing said switching signals and determining the speed of rotation of said rotary switching means, said circuit means for sensing and switching signals including a time counter, said time counter counting a clocking signal from said divider network during the time between consecutive closings of said contacts of said rotary switch;

circuit means for inputting supplemental pulses into said time-measuring circuits for correcting said display, said time measuring circuits including a first counter for lower magnitudes of data representative of a time function and a second counter for high magnitudes of said data, said supplemental pulses being inputted selectively to said counters and being provided by said divider signals, the number of said supplemental pulses being selected in correspondence with said rotational speed of said rotary switching means; and memory means for storing rotational speed data generated by said circuit means for sensing rotational speed.

14. A time-correcting mechanism as claimed in claim 7, wherein said circuit means for inputting supplemental pulses includes switch means, the condition of said switch means determining selectively either the lower-magnitude first data counter for receiving said supplemental pulses or both the lower- and higher-magnitude data counters for receiving said supplemental pulses.

15. A time-correcting mechanism as claimed in claim 14, wherein the number of said supplemental pulses delivered to said data counters is predetermined by the capacity of a third counter, said third counter receiving said supplemental pulses simultaneously with said data counters, said third counter periodically outputting a signal to control said switch means of said means for inputting supplemental pulses and block further supplemental pulses from said higher- and lower-magnitude data counters.

16. A time-correcting mechanism as claimed in claim 15, wherein a high count in said time counter causes said switch means to pass a single supplemental pulse to said lower-magnitude data counter, a lesser count in said time counter passing a plurality of said supplemental pulses to said lower-magnitude data counter, a still-lower count in said time counter causing said switch means to pass a plurality of said supplemental pulses simultaneously to both said higher- and lower-magnitude data counters.

17. A time-correcting mechanism as claimed in claim 7 or 16, wherein said lower-magnitude data counter is a one-minute counter and said higher-magnitude data counter is a ten-minute counter.

18. A time-correcting mechanism as claimed in claim 1, 7 or 16, wherein said rotary switching means cooperates with an external member which is rotated.

19. A time-correcting mechanism as claimed in claim 18, wherein said external member cooperates with a second switch, a push-pull operation of said external member causing actuation of said second switch.

* * * * *